US005524566A

United States Patent [19]

Rapa et al.

[11] Patent Number: 5,524,566

[45] Date of Patent: Jun. 11, 1996

[54] DOCK LINE SHOCK ABSORBER

[76] Inventors: Paul J. Rapa, 2040 Polk St., Box 257, San Francisco, Calif. 94109; Angus MacDonald, 3335 Fernside Blvd., Alameda, Calif. 94501

[21] Appl. No.: 492,773

[22] Filed: Jun. 21, 1995

Related U.S. Application Data

[63] Continuation-in-part of Ser. No. 308,159, Sep. 19, 1994, abandoned.

[51] Int. Cl.[6] ..... B63B 21/00

[52] U.S. Cl. ..... 114/230; 114/214

[58] Field of Search ..... 114/214, 215, 114/230; 267/113

[56] References Cited

U.S. PATENT DOCUMENTS

| | | | |
|---|---|---|---|
| 957,315 | 5/1910 | Duncanson | 114/214 |
| 3,094,096 | 6/1963 | Florence | 114/253 |
| 3,817,507 | 6/1974 | Darman et al. | 267/74 |
| 4,672,908 | 6/1987 | Goulooze | 114/214 |
| 4,754,957 | 7/1988 | Muttart | 114/215 |
| 4,967,681 | 11/1990 | Strain et al. | 114/215 |
| 5,046,442 | 9/1991 | Hay | 114/230 |
| 5,307,753 | 5/1994 | Besonen et al. | 114/230 |

*Primary Examiner* Stephen Avila
*Attorney, Agent, or Firm* Flehr, Hohbach, Test, Albritton & Herbert; Donald N. MacIntosh

[57] ABSTRACT

Shock absorber apparatus for mooring lines of boats and yachts includes an automotive type, double acting, telescopic shock absorber arranged in a two part, telescoping cage with attachment rings on each end for the mooring lines. Tensile forces in the lines caused by wave action or the like elongates and cage and compresses the shock absorber and minimizes force transfer to the yacht. Relaxation of the tensile force in the lines permits the unit to return to a neutral condition.

5 Claims, 3 Drawing Sheets

18
37
32C
32A
21B
32B
21A
32
36
19

-5-
-5-
18
37
32
21
31A
31B
31
31C
36
19
-4-
-4-

18
32
37

31
19
36

DOCK LINE SHOCK ABSORBER

REFERENCE TO PRIOR APPLICATION

This is a continuation-in-part of application Ser. No. 08/308,159 filed Sep. 19, 1994 now abandoned.

FIELD OF THE INVENTION

This invention relates to a shock absorber apparatus for mooring lines of boats, yachts and the like, and more particularly to a shock absorber adapted to be connected with a mooring cable that is, in turn, connected with a boat or yacht that is tied to a dock, or buoy, to attenuate greatly the load transfer to the moored vessel or the dock, such as caused by the wake from a passing vessel.

DESCRIPTION OF THE RELATED ART

Boats and yachts spend a substantial portion of their useful lives moored to a dock or a tender by means of mooring lines. These are intended to withstand the tensile loads created when the boat or vessel is shifted by wave action from passing ships or from current or tidal action. The mooring lines or cables have a tendency to break when high tensile loads are applied suddenly or when the cables are old and have deteriorated from the environmental action of sunlight and water. It is well known that the wake from a passing vessel causes the mooring lines of a docked yacht to first relax, gathering some slack, and then as the wave ebbs, the lines become taut imparting a shock in the line which is transmitted to the yacht itself. This is particularly unpleasant if the yacht serves as a residence especially at times when the crew aboard is seeking some restorative sleep. The shocks applied are disruptive as well as having deleterious effects on the mooring lines. This will be understood even though the mooring cables do not initially break, repeated applications of impact loads gradually stretch and weaken the mooring lines so that, ultimately, a failure occurs.

Several different types of shock absorber structures have been suggested in the past for accommodating the tensile shock loads in anchor cables and mooring lines. One of the simplest solutions to the problem was to wrap the mooring line around a length of elastic rubber material such that the rubber served to tighten the lines as shown in U.S. Pat. No. 3,817,507 to Derman. This construction tended to wear out quickly and was only marginally effective in controlling the larger shocks in the associated mooring lines. Another arrangement was to use a spring mounted in a frame so that the pull upon the line tended to compress the spring which, when the tensile forces in the line diminished to less than the spring force, the spring reacted to diminish the shock effect. Such apparatus was noisy and thus interfered with the comfort of those living on, say, a house boat, and springs from contact with sea water had a short service life and often failed. One such spring arrangement in shown in the Strain, et al. U.S. Pat. No. 4,967,681, which incorporated a nest of springs in a housing mounted so that the springs compress as tensile loads were applied to members in the housing supporting the springs. Such an arrangement is costly to manufacture and the multiple springs are all vulnerable to the corrosive effect of sea water. A simplified spring action upon a mooring line is disclosed in the Muttart U.S. Pat. No. 4,754,957, where the mooring cable is wrapped in a loop which embraces a spring, all disposed within a casing. The elongated helical compression spring was squeezed lengthwise by the mooring line in response to tensile loads. The Florence U.S, Pat. No. 3,094,096 discloses an encased spring and shock absorber piston arranged within a housing with sea water admitted into the housing and in contact with the springs. In each case the shock absorbing apparatus involved a spring as a vital component which is unsatisfactory due to the natural degradation of springs in contact with sea water, as well as the noise which is often generated from the very high impact loads in mooring cables.

Accordingly, it is an object of the present invention to provide an improved shock absorber apparatus for use with mooring cables for vessels, boats and yachts in order to avoid the sudden jerking forces from impact loads that would otherwise disturb the vessel and its occupants as well as greatly stress the mooring lines.

SUMMARY OF THE INVENTION

Briefly stated, in accordance with one aspect of the present invention, a telescopic double acting shock absorber of the automotive type is mounted in a two-part cage with each cage being connected to one of the shock absorber ends. Each cage has attachment means for mounting the mooring lines and guide means serve to maintain the alignment of the two cage portions which, when tensile forces are applied to the mooring line, the load compress the shock absorber, which in turn extends gradually as the tensile force diminishes, thus greatly attenuating the abrupt load transfer through the mooring lines to the boat, dock or the like.

Another object of the invention is to provide an improved dock line shock absorber which is simple in construction, easy to manufacture and which has few wearing parts vulnerable to sea water corrosion.

Another object is to provide an improved mooring or tie-up system for a yacht or the like which functions to greatly extend the life of the tie-up lines by providing a shock absorbing action in the mooring line system.

Another object of the invention is to provide a dock line shock absorber of the type described wherein a standard automotive type shock absorber being sealed from sea water entry is incorporated, thus greatly easing the cost of manufacture.

These and other objects will be apparent from the description which follows taken in connection with the associated drawings.

DESCRIPTION OF THE PREFERRED EMBODIMENTS

Figures 1, 6:
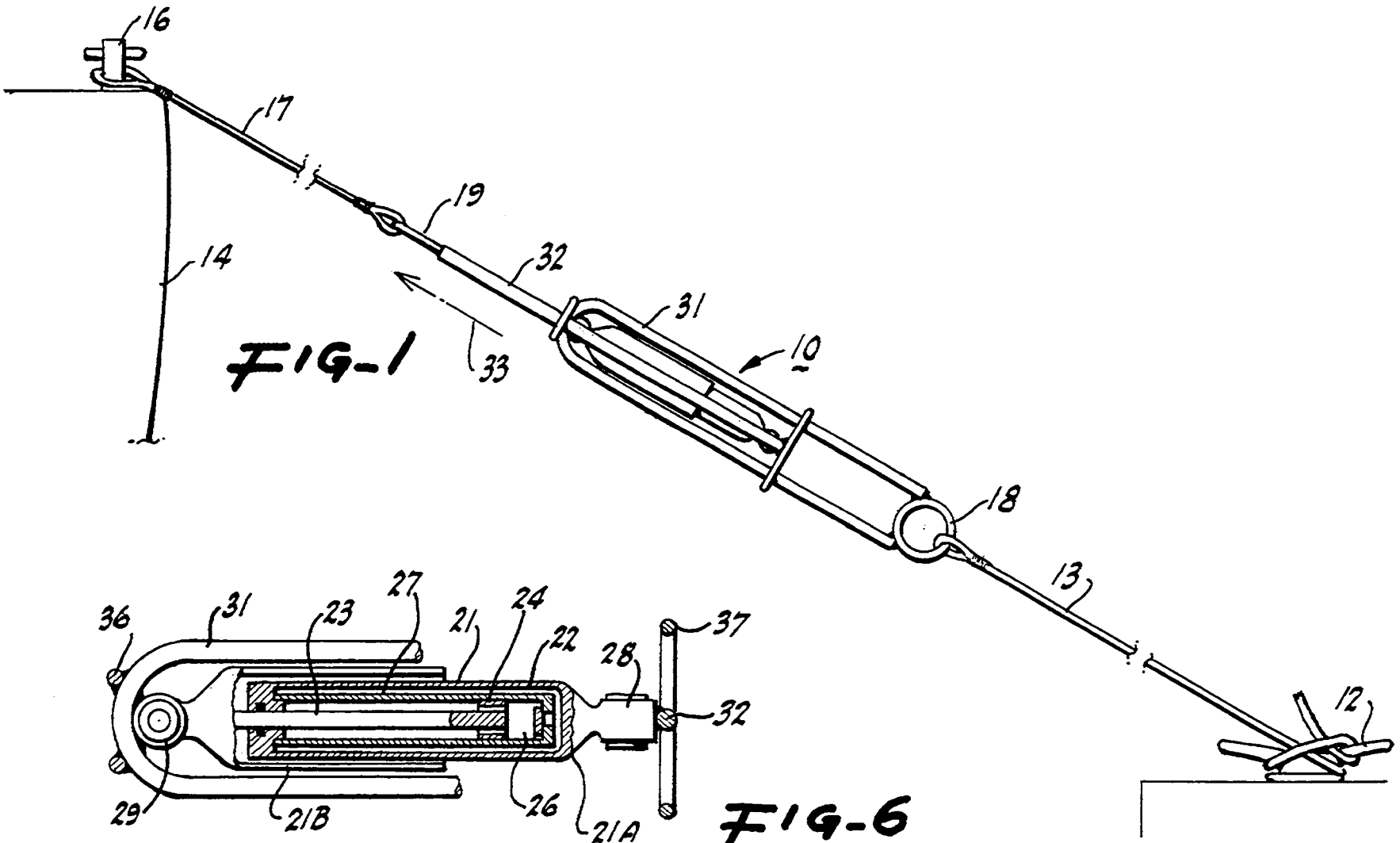
FIG. 1 is a view of the dock line shock absorber of a first preferred embodiment of the present invention shown coupled to mooring lines and extending between a floating vessel and a dock cleat.
FIG. 6 is a sectional view of the unit shown in the fully contracted condition.

A dock line or mooring line shock absorber 10 of one preferred form of the present invention is shown in the drawings and referring particularly to FIG. 1, there is depicted a quay 11 having a cleat 12 extending upwardly therefrom around which is looped a mooring line 13. A sea-going vessel, such as boat or yacht 14, is shown fragmentarily and carries a mooring cleat 16 to which the vessel's dock line 17 is secured fast. The mooring lines 13 and 17 are each secured, respectively, to the ends of the dock line shock absorber unit 10 through attachments rings 18 and 19. The dock lines 13 and 17 are often made from synthetic materials which have been proven to have a long service life, and natural materials such as Manila hemp or steel cable may serve in preferred applications.

Figures 2, 3, 4, 5:
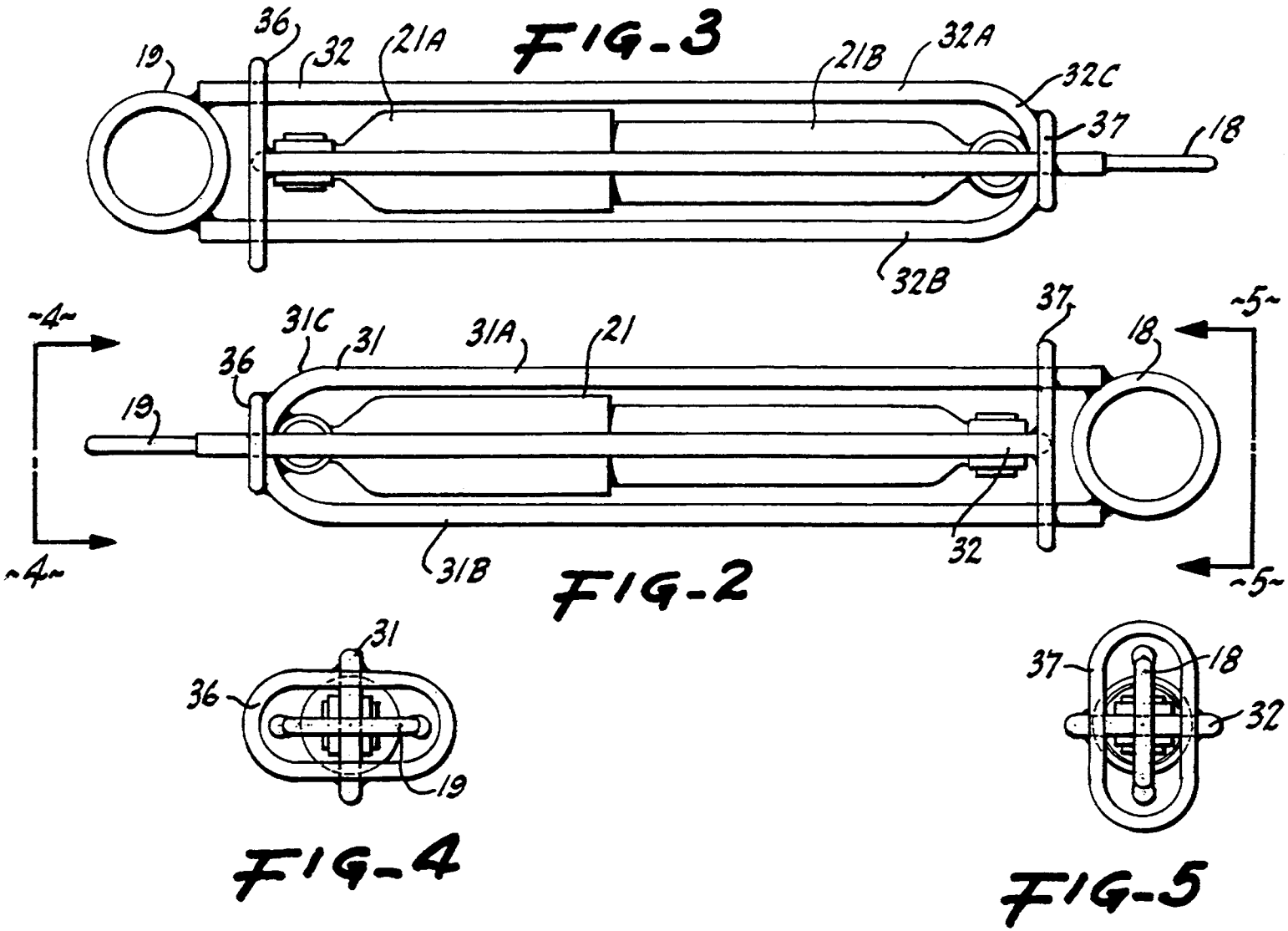
FIG. 2 is an enlarged view of the dock line shock absorber assembly of FIG. 1 shown in an elevation view, fully contracted.
FIG. 3 is a view of the dock line shock absorber of FIG. 2 taken in plan view.
FIG. 4 is an end view taken in the directions of the arrows 4—4 of FIG. 2.
FIG. 5 is an end view taken in the directions of the arrows 5—5 of FIG. 2.

The dock or mooring line shock absorber assembly 10 includes a double acting, telescopic gas-filled shock absorber 21 of the type commonly mounted on automobiles. As manufactured, the shock absorbers preferred are those which are sealed against the sea water entry, thus protecting the internal components from corrosion, debris and the like. One useful shock absorber 21 for purposes of this invention is made by the Monroe Auto Equipment Company and is available in a range of capacities and it is preferred to use a shock absorber having a 1⅞ inch diameter reserve tube with a 9/16 inch diameter piston rod, as shown in FIG. 6. A piston 24 is mounted for reciprocation in the fluid-filled cavity 26 and a charge of nitrogen gas is introduced in the space 27 between the intercylinder walls. The shock absorber 21 works in the well understood fashion between the compressed mode as seen in FIG. 6 to a normal or neutral condition mode as shown in FIGS. 2 and 3 and is designed to absorb shocks when reciprocating in each direction between the normal and compressed modes. A compressed air charged shock absorber (not shown) is also suitable to this invention wherein an external air fill valve is mounted at one end of the shock absorber through which a quantity of air may be introduced or exhausted to vary selectively the internal working pressure of the unit which may be adjusted to suit the conditions of use in the dock line mooring system.

A steel mounting boss 28 and 29 is included on each end of the telescoping body portions of the shock absorber. A U-shaped strut 31 and 32 is fixedly secured, respectively, to the bosses 29 and 28, such as by welding, and extends the full length of the shock absorber 21 in its neutral state as illustrated in FIGS. 2 and 3. Each strut 31, 32 include a spaced apart pair of strut legs which project from the curved section C which is secured to the boss.

The legs are fixedly secured at their distal ends to one of the attachment rings 18 or 19, best shown in FIGS. 2 and 3. It will be understood from this construction and arrangement that as tensile forces, as indicated by the arrow 33, FIG. 1, are applied in the mooring line 17, 13, the mooring rings and associated struts will be pulled oppositely to thereby compress the shock absorber 21 encased within the cage formed by the strut legs, as shown in FIG. 6. When the tensile force is diminished, the shock absorber returns its telescoping portions 21*a*, 21*b* towards a neutral condition, FIGS. 2, 3. The shock absorber has suitable internal orifices and valves to accommodate fluid movement therein to achieve the shock absorbing functions as well understood in the field.

To guide and control the struts 31, 32 as well as to control the degree of rotation of the two shock absorber telescoping portions 21A and 21B, guides 36 and 37 are fixedly secured to the curved portions of the struts 31 and 32, respectively. The guides 36 and 37 are in the form of steel loops and as shown in FIGS. 4 and 5, permit the strut legs freely to reciprocate, but arrest rotational movements of the struts by engagement with the guides 36, 37 inner periphery.

It will be understood from the above that with the shock absorber unit 10 mounted in the mooring lines coupling a boat 14 to a dock 11, that waves caused by a passing vessel induce forces 33 in the mooring lines and the boat 14 bobs and shifts in response to the wave action. The force causes the cage of the unit 10 to elongate, thereby compressing the automotive type shock absorber and attenuating the severity of the shock induced in the mooring line. This is especially important to the crew or residents of the boat 14 and permits a longer life of the mooring lines and serve to reduce the incidence of broken mooring cables. It has been observed that the introduction of but a single dock line shock absorber unit into the mooring line system of a yacht having a plurality of working lines serves to greatly prolong the life of all of the mooring lines.

Figures 7, 8, 9, 10:
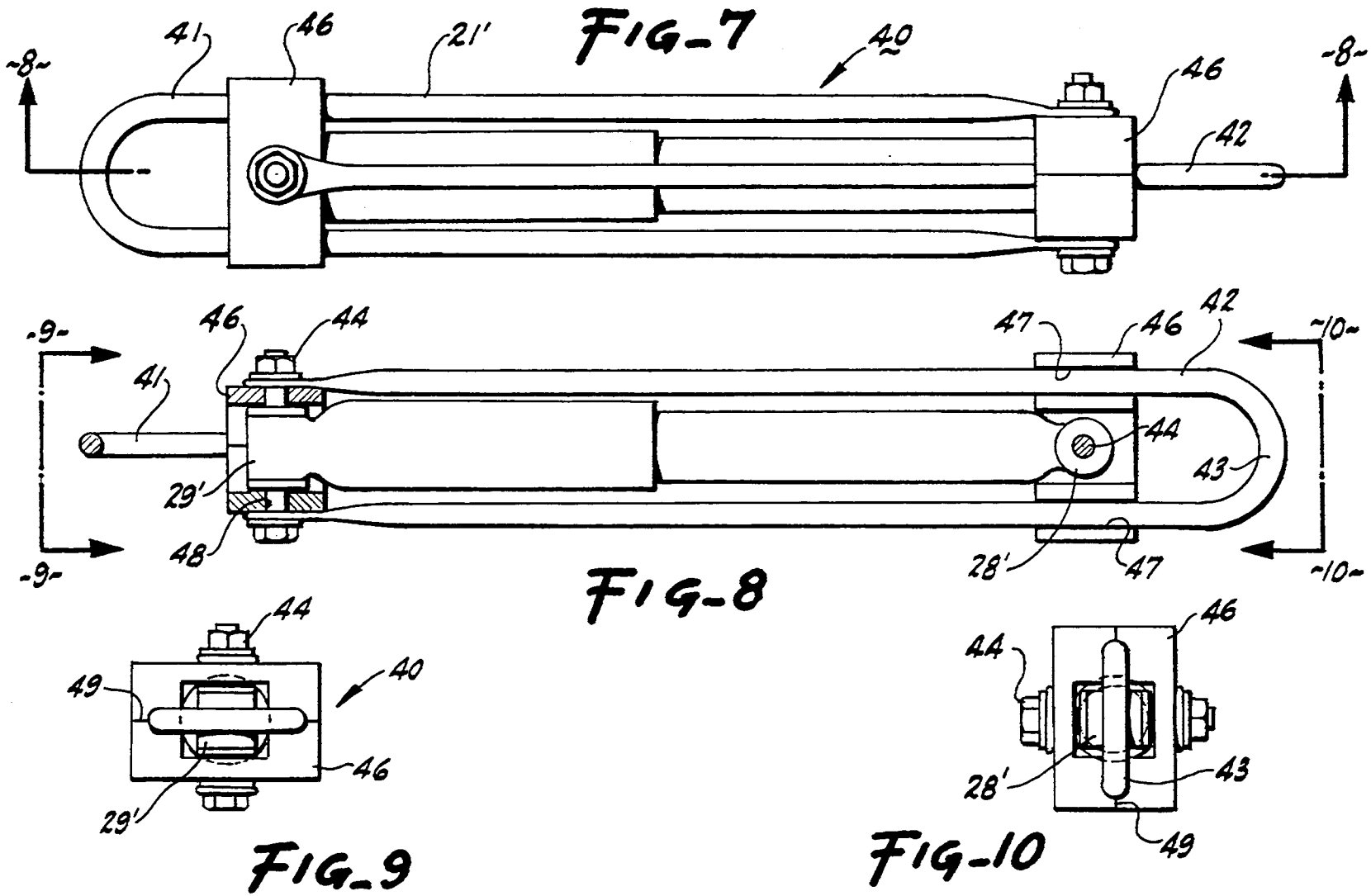
FIG. 7 is view like FIG. 3 but showing a second preferred embodiment of the present invention.
FIG. 8 is a view of the dock line shock absorber of FIG. 7 taken in the direction of the arrows 8—8 therein.
FIG. 9 is an end view taken in the direction of the arrows 9—9 of FIG. 8.
FIG. 10 is a view of the opposite end of the dock line shock absorber taken in the direction of the arrows 10—10 of FIG. 8.

A second preferred embodiment of the invention 40 is shown in FIGS. 7–10. The embodiment 40 comprises components described above and for this reason like reference numerals used to designate those but carry a prime (') signifier. The shock absorber 21' is included in the unit 40 and works in the well understood fashion as mentioned above. A steel mounting boss 28', 29' is included on each end of the telescoping body portion of the shock absorber 21'. A U-shaped strut 41 and 42 is fixedly secured, respectively, to the bosses 29' and 28' in a manner to be described more completely below. The struts extend the full length of the shock absorber 21' as shown in FIGS. 7 and 8. Each strut 41 and 42 includes a spaced apart pair of strut legs which project from the curved C-shaped section thereof 43 which serves as an attachment means for the mooring line 13. The strut legs at their distal ends are fixedly secured by a stainless steel or bronze fastener assembly 44 to the boss 28' or 29' of the shock absorber 21' as well as to a guide means 46. Each guide means 46 receives therethrough a pair of legs or struts 41, 42 each leg through a longitudinal bore 47 as indicated in FIG. 8. The bore 47 is sized so that the strut legs will be slidably accommodated therethrough. The guide means 46 may be formed of any suitable water tolerant material, such as wood, plastic or metal, wood being shown in this particular preferred embodiment. The guide means includes a bore 48 sized to receive the fastener 44, the bolt portion thereof as indicated in FIGS. 8–10. For convenience of manufacture, the guide means may be formed most conveniently as a block of material having a parting surface 49 as indicated in FIGS. 9 and 10.

From the above description and with reference to FIGS. 8 and 10, it is apparent that the first U-shaped strut 41 is secured by the fastener assembly 44 to the guide means block 46 and to the boss 28' on the shock absorber 21'. Similarly, the second U-shaped strut 42 is secured to the guide block means 46 by the fastener assembly 44, thus coupling to the boss 29'.

With the mooring lines 13, 17 secured to the C-shaped sections 43 of the struts, tension in the lines will cause the guide blocks 46 to move towards one another against the resistance of the shock absorber 21'. When the tension in the mooring lines is relaxed, the internal forces within the shock absorber 21' cause the shock absorber sections to move to their normal at rest position thereby shifting the guide blocks 46 apart.

Although two particular embodiments of the present invention have been illustrated and described, it will be apparent to those skilled in the field that various changes and modifications can be made without departing from the spirit of the present invention. Accordingly, it is intended to encompass in the appended claims, all such changes and modifications that fall within the scope of the present invention.

What is claimed is:

1. A dock line shock absorber apparatus for mooring lines of boats, yachts and the like for absorbing high tensile loads such as induced by waves from passing vessels acting on the moored yacht causing a sudden high tensile load in the mooring lines and serving to attenuate the abrupt load transfer to the moored yacht or the dock or the like to which it is moored, said shock absorber apparatus comprising in combination, an enclosed telescopic shock absorber of the automotive type including means sealing against water entry and having force attenuation capability in the compression mode, said shock absorber including a first body portion carrying a piston and piston rod and a second body portion telescopically related to said first portion serving to receive said piston for linear movements therein in response to forces applied thereto, a boss fixedly mounted upon each distal end of said body portions, first and second attachment rings, said attachment rings serving respectively to receive and secure a mooring line tied to such yacht and a mooring line tied to the dock, first strut means fixedly mounted at one end to said boss on said first body portion and on the other end fixedly mounted upon said first attachment ring, second strut means fixedly mounted at one end to said boss on said second body portion and on the other end fixedly mounted upon said second attachment ring such that tensile forces applied to said attachment rings from the mooring lines serve to compress and telescope said body portions of the shock absorber, first strut guide means fixedly mounted on said first strut means serving to guide and control the movements of said second strut means, and second strut guide means fixedly mounted on said second strut means serving to guide and control the movements of said first strut means.

2. The dock line shock absorber apparatus of claim 1 wherein said first and second strut means each comprise elongated U-shaped members, said members including a curved medial portion mounted upon said boss and including leg portions extending generally parallel to said shock absorber the full length thereof, the ends of said legs being mounted to said attachment rings.

3. The apparatus of claim 2 wherein said strut guide means includes a member mounted to said medial portion of said one strut means and extending laterally outwardly of the leg portions of the other strut means such that the first and second strut means are disposed in a mutually perpendicular relationship.

4. A dock line shock absorber apparatus for mooring lines of boats, yachts and the like for absorbing high tensile loads such as induced by waves from passing vessels acting on the moored yacht causing a sudden high tensile load in the mooring lines and serving to attenuate the abrupt load transfer to the moored yacht or the dock or the like to which it is moored, said shock absorber apparatus comprising in combination, an enclosed telescopic, gas filled shock absorber of the automotive type which is normally in full extension due to the pressurized gas contained therein and which includes means sealing against water entry, a first elongated U-shaped strut, a second elongated U-shaped strut disposed with the general plane thereof substantially perpendicular to the general plane of said first U-shaped strut so as to define a cage surrounding said shock absorber, first coupling means joining the ends of said first U-shaped strut to one end of said shock absorber, and second coupling means joining the ends of said second U-shaped strut to the other end of said shock absorber, said struts including means for attachment of mooring lines tied to such yacht and to the dock such that as tension forces in the mooring lines increases the distance between the first and second strut ends increases serving to compress the shock absorber and when the tension forces diminish the shock absorber extends itself due to the gas pressure within thereby taking up slack in the mooring lines.

5. The dock line shock absorber apparatus of claim 4 wherein said first and second coupling means serve as guide means for controlling the movements of said strut means.

* * * * *